US009309773B2

(12) United States Patent
Sayano et al.

(10) Patent No.: US 9,309,773 B2
(45) Date of Patent: Apr. 12, 2016

(54) STEAM TURBINE AND STEAM TURBINE BLADE

(75) Inventors: Akio Sayano, Yokohama (JP); Masashi Takahashi, Yokohama (JP); Masahiro Saito, Yokohama (JP); Kazuyoshi Nakajima, Hiratsuka (JP); Tadashi Tanuma, Yokohama (JP); Satoru Asai, Chigasaki (JP); Kenji Kamimura, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 39 days.

(21) Appl. No.: 12/977,548

(22) Filed: Dec. 23, 2010

(65) Prior Publication Data

US 2011/0150641 A1 Jun. 23, 2011

Related U.S. Application Data

(63) Continuation of application No. PCT/JP2009/002838, filed on Jun. 22, 2009.

(30) Foreign Application Priority Data

Jun. 23, 2008 (JP) ..... P2008-163209

(51) Int. Cl.
*F01D 5/28* (2006.01)
*C23C 18/12* (2006.01)

(52) U.S. Cl.
CPC ..... *F01D 5/286* (2013.01); *C23C 18/1208* (2013.01); *F05D 2220/31* (2013.01); *F05D 2230/90* (2013.01); *F05D 2250/60* (2013.01)

(58) Field of Classification Search
CPC ..... F01D 5/14; F01D 5/145; F01D 5/284; F01D 5/286; F05D 2300/21; F05D 2300/2112; F05D 2230/31; F05D 2230/312; F05D 2230/314
USPC ..... 416/241 B, 241 R
See application file for complete search history.

(56) References Cited

U.S. PATENT DOCUMENTS 5,789,077 A 8/1998 Nakahama et al.
6,174,132 B1 * 1/2001 Shiga et al. ..... 415/199.5
(Continued)

FOREIGN PATENT DOCUMENTS

EP 0 690 144 B1 11/2001
EP 1 403 397 A1 3/2004
(Continued)

OTHER PUBLICATIONS

White, Frank M., Fluid Mechanics, Fourth Ed., 1999 McGraw-Hill. pp. 439 and 441-444.*
(Continued)

*Primary Examiner* — Sean J Younger
(74) *Attorney, Agent, or Firm* — Oblon, McClelland, Maier & Neustadt, L.L.P.

(57) ABSTRACT

A steam turbine 3 includes: a turbine rotor 4; a rotor blade 5 implanted to the turbine rotor 4; a stator blade 6 provided at an upstream side of the rotor blade 5; and a turbine casing 13 supporting the stator blade 6 and including the turbine rotor 4, the rotor blade 5 and the stator blade 6, and have a constitution in which a stage 7 is formed by a pair of the rotor blade 5 and the stator blade 6, and a steam passage 8 is formed by arranging plural stages 7 in an axial direction of the turbine rotor 4. A surface treatment to suppress an increase of a surface roughness caused by oxidation is performed for at least a part of a surface of the stator blade 6 and a surface of the rotor blade 5.

15 Claims, 2 Drawing Sheets

(56) References Cited

U.S. PATENT DOCUMENTS

| | | | | |
|---|---|---|---|---|
| 6,294,260 | B1 * | 9/2001 | Subramanian | 428/469 |
| 6,296,945 | B1 * | 10/2001 | Subramanian | 428/469 |
| 6,986,951 | B2 | 1/2006 | Giannozzi | |
| 7,256,232 | B2 * | 8/2007 | Lamaze et al. | 524/430 |
| 7,364,802 | B2 * | 4/2008 | Spitsberg et al. | 428/633 |
| 7,867,624 | B2 * | 1/2011 | Barnikel et al. | 428/633 |
| 8,132,414 | B2 * | 3/2012 | Niizeki et al. | 60/670 |
| 8,277,194 | B2 | 10/2012 | Jabado et al. | |
| 2003/0008167 | A1 * | 1/2003 | Loch et al. | 428/632 |
| 2003/0129061 | A1 * | 7/2003 | Finn et al. | 416/224 |
| 2004/0097170 | A1 * | 5/2004 | Bolz et al. | 451/36 |
| 2005/0129862 | A1 * | 6/2005 | Nagaraj et al. | 427/402 |
| 2006/0194526 | A1 * | 8/2006 | Bolz et al. | 451/104 |
| 2006/0246825 | A1 * | 11/2006 | Bolz et al. | 451/36 |
| 2007/0101719 | A1 | 5/2007 | Niizeki et al. | |
| 2008/0107920 | A1 * | 5/2008 | Rowe et al. | 428/701 |
| 2008/0166587 | A1 | 7/2008 | Barnikel et al. | |

FOREIGN PATENT DOCUMENTS

| | | |
|---|---|---|
| JP | 8-74024 | 3/1996 |
| JP | 8-74025 | 3/1996 |
| JP | 2000-282805 | 10/2000 |
| JP | 2002-38281 | 2/2002 |
| JP | 2003-176727 | 6/2003 |
| JP | 2004-169176 | 6/2004 |
| JP | 2004-232499 | 8/2004 |
| JP | 2006-37212 | 2/2006 |
| JP | 2007-119802 | 5/2007 |
| JP | 2007-120478 | 5/2007 |
| JP | 2008-50699 | 3/2008 |
| WO | WO 2007/082823 A1 | 7/2007 |

OTHER PUBLICATIONS

English translation of International Preliminary Report on Patentability issued Mar. 10, 2011, in Patent Application No. PCT/JP2009/002838.

Notice of Reasons for Rejection issued Dec. 18, 2012 in Japanese Patent Application No. 2010-517750 (with English translation).

N. M. Vaxevanidis et al., "Surface Integrity and Tribological Behavior of Plasma Sprayed Alumina Coating on Steel and Aluminum Substrates", Tribology in Industry, vol. 26, No. 1 & 2, 2004, pp. 42-47.

International Search Report issued Sep. 15, 2009 in PCT/JP2009/002838 filed Jun. 22, 2009.

Written Opinion issued Sep. 15, 2009 in PCT/JP2009/002838 filed Jun. 22, 2009.

* cited by examiner

STEAM TURBINE AND STEAM TURBINE BLADE

CROSS-REFERENCE TO RELATED APPLICATIONS

This application is a continuation of prior International Application No. PCT/JP2009/002838, filed on Jun. 22, 2009 which is based upon and claims the benefit of priority from Japanese Patent Application No. 2008-163209, filed on Jun. 23, 2008; the entire contents of all of which are incorporated herein by reference.

FIELD

Embodiments described herein relate generally to steam turbine and a steam turbine blade used for a power generation plant and so on.

BACKGROUND

In a steam turbine, pressure and temperature energy of high-temperature and high-pressure steam supplied from a boiler is converted into rotational energy by using a blade cascade combining stator blades and rotor blades. FIG. 2 illustrates a conceptual view of a power generation system using the steam turbine as stated above.

As illustrated in FIG. 2, steam generated at a boiler 1 is further heated at a heater 2, and guided to a steam turbine 3.

The steam turbine 3 is made up by arranging stages made up of a combination of a rotor blade implanted in a circumferential direction of a turbine rotor 4 and a stator blade supported by a casing in an axial direction of the turbine rotor 4 in plural stages. The steam guided to the steam turbine 3 expands inside a steam passage, and thereby, the high-temperature and high-pressure energy is converted into the rotational energy by the turbine rotor 4.

The rotational energy of the turbine rotor 4 is transmitted to a power generator 9 connected to the turbine rotor 4, and converted into electric energy. On the other hand, the steam losing the energy thereof is discharged from the steam turbine 3 and guided to a steam condenser 10. Here, the steam is cooled by a cooling medium 11 such as seawater, and condensed to be condensed water. This condensed water is supplied to the boiler 1 again by a feed pump 12.

The steam turbine 3 is made up by being divided into a high pressure turbine, an intermediate pressure turbine, a low pressure turbine, and so on depending on a condition of a temperature, a pressure of the supplied steam. In the power generation system as stated above, oxidation of parts of the rotor blades, the stator blades and so on of the steam turbine is remarkable because the parts are exposed to the high-temperature steam especially at the stages of the high pressure turbine and the intermediate pressure turbine.

Surface roughness of the rotor blade, the stator blade and so on of the steam turbine is reduced as much as possible by a method in which fine particles are sprayed on surfaces thereof or the like when they are incorporated as the parts. This is because a flow of fluid gets out of order at the surface of the blade and so on when the surface roughness of the parts is large, aerodynamic characteristics as a blade deteriorate resulting from separation, and this may cause deterioration of efficiency of the whole turbine.

These parts represent high aerodynamic performance in an initial state because the surface roughness is reduced when they are used in an actual plant. However, the surface roughness of these parts gradually becomes large as the oxidation of the surface of the parts proceeds, and the aerodynamic performance of the blade gradually deteriorates as an operation time passes. Accordingly, there is a problem that the efficiency of the turbine as a whole also deteriorates. Proposals as stated below have been made as arts relating to a surface treatment of the steam turbine parts.

A method is proposed in which a nitrided hard layer (radical nitrided layer) is formed and thereafter, a physical vapor deposition hard layer such as CrN, TiN, AlCrN is further formed thereon to improve an erosion resistance, an oxidation resistance, and a fatigue strength of the steam turbine parts and so on (for example, refer to JP-A 2006-037212 (KOKAI)).

Besides, a method is proposed in which a corrosion resistance and a high-temperature erosion resistance of the blade are improved by forming a layer composed of iron boride and nickel boride at the blade surface by performing a boride treatment by immersion after a nickel plating is performed, for a member for high temperature of the steam turbine blade and so on (for example, refer to JP-A 2002-038281 (KOKAI)).

A method is proposed in which the corrosion resistance, an abrasion resistance, and the erosion resistance are improved by forming a layer of $Cr_{23}C_6$ by a combination of a thermal spraying and a heat treatment for the steam turbine blade and so on (for example, refer to JP-A 08-074024 (KOKAI), JP-A 08-074025 (KOKAI)).

Besides, a method is proposed in which a corrosion resistance is improved by so-called a laser plating in which the cobalt based alloy of which composition is rigidly controlled is disposed to contact a base material, and thereafter, it is melted and adhered by using a laser for the steam turbine blade (for example, refer to JP-A 2004-169176 (KOKAI)).

A method is proposed in which erosion for solid particles is reduced by forming carbide ceramics ($Cr_3C_2$) by high temperature and high pressure gas flame spraying for the steam turbine blade (for example, refer to JP-A 2004-232499 (KOKAI)).

However, improvement in durability of blades is an object of all proposals, and they are not studied from points of views of a surface roughness change caused by oxidation and deterioration of aerodynamic characteristics of the blade in accordance with the surface roughness change. Accordingly, there has not been a proposal to perform the surface treatment from the point of view of the surface roughness change caused by the oxidation and the deterioration of the aerodynamic characteristics of the blade in accordance with the surface roughness change.

The present invention is made to correspond to the conventional circumstances, and an object thereof is to provide a steam turbine and a steam turbine blade capable of suppressing the surface roughness change of the steam turbine blade caused by the oxidation and the deterioration of the aerodynamic characteristics of the steam turbine blade in accordance with the surface roughness change, and maintaining an initial high turbine efficiency level for a long time.

The present inventors devote themselves to study relating to a steam turbine blade structure to maintain a turbine performance. As a result, the present invention is completed by finding out that it is possible to suppress the deterioration of the aerodynamic characteristics of the steam turbine blade by suppressing the surface roughness change caused by the oxidation, and to maintain the turbine performance at a high level for a long time by maintaining the initial high aerodynamic characteristics for the steam turbine blade.

Namely, an aspect of the steam turbine of the present invention includes: a turbine rotor; a rotor blade implanted to the turbine rotor; a stator blade provided at an upstream side of the rotor blade; and a turbine casing supporting the stator blade and including the turbine rotor, the rotor blade and the stator blade, in which a stage is formed by a pair of the rotor blade and the stator blade, and a steam passage is formed by arranging plural stages in an axial direction of the turbine rotor, and in which a surface treatment suppressing an increase of a surface roughness caused by oxidation is performed for at least a part of a surface of the stator blade and a surface of the rotor blade.

Besides, an aspect of a steam turbine blade of the present invention, used for a steam turbine including: a turbine rotor; a rotor blade implanted to the turbine rotor; a stator blade provided at an upstream side of the rotor blade; and a turbine casing supporting the stator blade and including the turbine rotor, the rotor blade and the stator blade, in which a stage is formed by a pair of the rotor blade and the stator blade, and a steam passage is formed by arranging plural stages in an axial direction of the turbine rotor, as the stator blade or the rotor blade, in which a surface treatment suppressing an increase of a surface roughness caused by oxidation is performed for at least a part of surfaces thereof.

DETAILED DESCRIPTION

Hereinafter, an embodiment of the present invention is described in detail with reference to the drawings.

Figure 1:
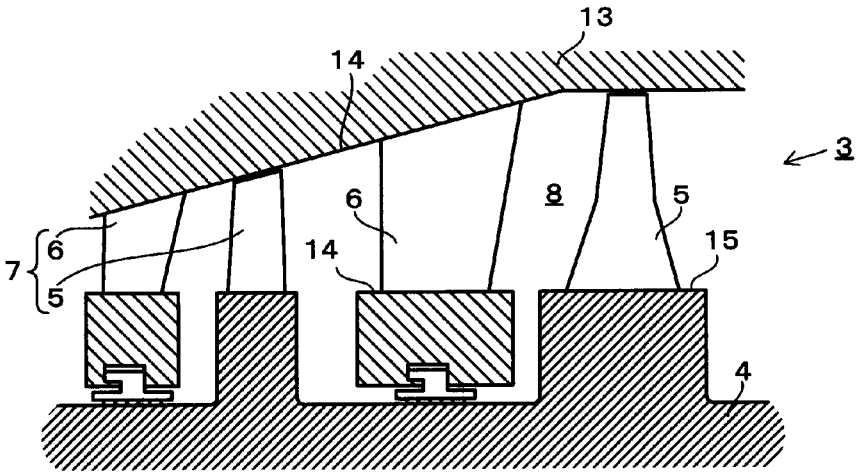
FIG. 1 is a view schematically illustrating a cross sectional configuration of a substantial part of a steam turbine and a steam turbine blade according to an embodiment of the present invention.
Figure 2:
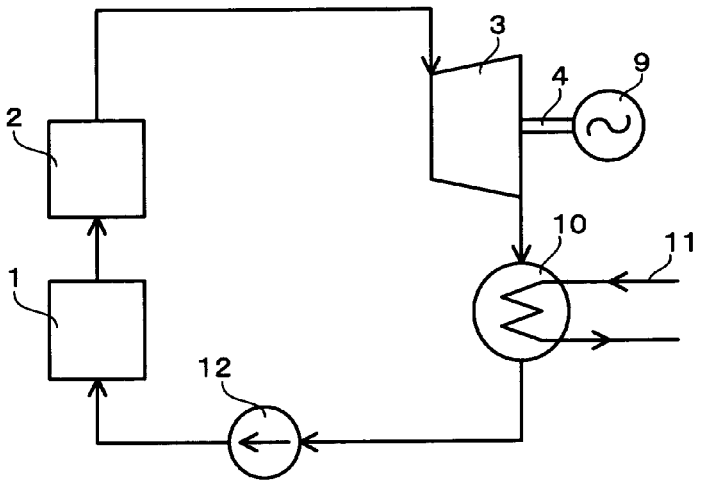
FIG. 2 is a conceptual view of a rankine cycle in a steam turbine power generation system.

FIG. 1 is a view illustrating a configuration of a steam turbine and a steam turbine blade according to an embodiment of the present invention. As illustrated in FIG. 1, a steam turbine 3 includes a turbine rotor 4, a rotor blade 5 implanted to the turbine rotor 4, a stator blade 6 provided at an upstream side of the rotor blade 5, and a turbine casing 13 supporting the stator blade 6 and containing the turbine rotor 4, the rotor blade 5 and the stator blade 6. A stage 7 is formed by a pair of the rotor blade 5 and the stator blade 6, and it is constituted such that a steam passage 8 is formed by arranging plural stages 7 in an axial direction of the turbine rotor 4. A surface treatment to suppress an increase of a surface roughness caused by oxidation is preformed for at least a part of a surface of the stator blade 6 and a surface of the rotor blade 5. It is thereby possible to suppress an energy loss of a steam flow in accordance with an increase of the surface roughness caused by the oxidation. Note that the passage portion 8 as a whole including the stator blade 6, the rotor blade 5, an end wall 14, and a platform 15 is generically called as a steam turbine blade.

In the present embodiment having the above-stated constitution, the surface treatment to suppress the increase of the surface roughness caused by the oxidation is performed for at least a part of the surface of the stator blade 6 and the surface of the rotor blade 5. Accordingly, a surface roughness change is small even when it is held at high temperature for a long period, and it is possible to maintain an initial blade shape and surface roughness for a long time when it is actually operated in a plant. It is therefore possible to maintain an initial high level efficiency of the steam turbine 3 as a whole for a long time.

It may be as aspect in which the surface treatment is performed for at least a part of the stator blades 6 at a high pressure stage and an intermediate pressure stage. Here, the reason why the stator blades 6 are particularly limited to the ones at the high pressure stage and the intermediate pressure stage is that temperatures of the high pressure stage and the intermediate pressure stage are high at approximately 350° C. to 610° C., and the oxidation is easy to proceed compared to a low pressure stage (350° C. to 20° C.), and an effect of the surface treatment is larger.

Besides, it may be an aspect in which the surface treatment is performed for at least a part of the rotor blades 5 at the high pressure stage and the intermediate pressure stage. Here, the reason why the stator blades 5 are particularly limited to the ones at the high pressure stage and the intermediate pressure stage is that the temperatures of the high pressure stage and the intermediate pressure stage are high at approximately 350° C. to 610° C., and the oxidation is easy to proceed compared to the low pressure stage (350° C. to 20° C.), and the effect of the surface treatment is larger.

The stator blade 6 and the rotor blade 5 can be composed of ferritic steel. Generally, the ferritic steel is used for the stator blade 6 and the rotor blade 5 of the steam turbine 3 from a point of view of a balance between material properties such as a fatigue strength, a creep resistance characteristic, and a cost. Conventionally, a turbine performance is lowered because the surface roughness increases resulting from the gradually proceeding oxidation, when these stator blade 6 and the rotor blade 5 are used in an actual plant. Here, the ferrite steel is defined to be the steel having a body-centered cubic structure. It is possible in the present embodiment to suppress the energy loss of the stream flow in accordance with the increase of the surface roughness caused by the oxidation because the surface treatment to suppress the increase of the surface roughness caused by the oxidation is performed even in a case when the ferritic steel as stated above is used. High chromium steel can be cited as an example of the ferritic steel. Besides, the stator blade 6 and the rotor blade 5 can be composed of super heat-resistant alloy. Recently, there is a case when the super heat-resistant alloy is used as a material of the stator blade 6 and the rotor blade 5 instead of the conventional ferritic steel depending on cases because a plant operation temperature becomes higher to improve turbine efficiency. The super heat-resistant alloy is defined as a cobalt based or nickel based material. It is possible in this case also to suppress the energy loss of the stream flow in accordance with the increase of the surface roughness caused by the oxidation because the surface treatment to suppress the increase of the surface roughness caused by the oxidation is performed.

The surface treatment is preferable to be the surface treatment not to increase the surface roughness of a base material of the stator blade 6 and the rotor blade 5. A principle object of the present invention is not to increase the surface roughness. The surface treatment causing the increase of the surface roughness of the stator blade 6 and the rotor blade 5 is not preferable even if the surface treatment improving oxidation resistance is performed. In almost all of surface treatment methods currently applied or tried to be applied to the steam turbine blade such as a thermal spraying, the surface roughness increases and the aerodynamic characteristics of the steam turbine blade is lowered by performing the surface treatment.

It is possible to apply a surface treatment including a process coating a ceramics precursor on the surfaces of the stator blade 6 and the rotor blade 5, and a process decomposing the ceramics precursor by a heat treatment as the surface treatment. According to this surface treatment, a thin film of ceramics is formed evenly, and therefore, the surface roughness change resulting from performing the surface treatment is extremely small. Accordingly, the initial aerodynamic characteristics of the stator blade 6 and the rotor blade 5 are not lowered. Besides, the oxidation of the stator blade 6 and the rotor blade 5 is suppressed by a membrane of the ceramics formed by the decomposition by heating of the coated precursor, and an initial high blade aerodynamic performance can be maintained for a long time. Accordingly, it becomes possible to maintain the turbine performance of the plant at high level for a long time.

As for the surface roughness after the surface treatment, a maximum height is preferable to be 1.6 μm or less. This is because turbulence of stream flow seldom occurs and there is no effect on the blade aerodynamic performance when a maximum height Rmax of the surface roughness is 1.6 μm or less, but the turbulence of the stream flow occurs and the blade aerodynamic performance is lowered when the maximum height of the surface roughness is 1.6 μm or more.

The membrane formed by the surface treatment is preferable to be oxide ceramics. This is because an oxidation resistance property and a corrosion resistance of the oxide ceramics are excellent. It can be prevented that the steam and metal base material directly come into contact with each other owing to the membrane composed of the oxide ceramics.

An average thickness of the membrane formed by the surface treatment is preferable to be 0.01 μm or more and 50 μm or less. Here, the reason why the film thickness of the coating membrane is set to be 0.01 μm or more and 50 μm or less is as stated below. Namely, when the film thickness is thinner than 0.01 μm, it is impossible for the coating membrane to evenly cover the base material, as a result, the base material exposes partially, and the oxidation resistance of the base material deteriorates drastically. On the other hand, when the film thickness is thicker than 50 μm, an adhesion strength of the coating membrane relative to the base material is lowered, and therefore, cracks occur at the coating membrane, the oxidation resistance of the base material deteriorates, and a problem such as a peeling of the coating membrane from the base material occurs.

The membrane formed by the surface treatment is preferable to be at a position of less than 10 mm from a rear edge of the stator blade 6 and the rotor blade 5 toward an upstream side and at a back side. This is because the position of less than 10 mm from the rear edge of the stator blade 6 and the rotor blade 5 toward the upstream side and at the back side is an important portion determining the aerodynamic characteristics of the stator blade 6 and the rotor blade 5, and the surface roughness of this portion largely affects on the turbine efficiency.

As an example, a $TiO_2$ based ceramics precursor is coated on all of a steam passage part surface including platform parts of all the stator blades 6 composed of the high chromium steel at the intermediate pressure stage and the high pressure stage of the steam turbine, and thereafter, an titanium oxide based ceramics membrane is formed by performing a heat treatment at 400° C. for 10 minutes to decompose the precursor by heating.

When the surface roughness is measured after the membrane is formed, the Rmax (the maximum height of the surface roughness) being a specification of the base material of the stator blade 6 is turned out to be 1.6 μm or less. The film thickness at this time is 0.8 μm. As a result of measurement of the surface roughness of each stator blade 6 after this steam turbine is test operated at 400° C. for 1000 hours, a remarkable increase of the surface roughness is not recognized.

As another example, a membrane is formed by the same method except that the film thickness is set to be 0.008 μm, and an evaluation is performed by the same method. As a result, the Rmax (the maximum height of the surface roughness) is 1.6 μm or less before the test operation at 400° C. for 1000 hours, but the Rmax becomes 4 μm after the test operation, and the increase of the surface roughness is recognized.

As still another example, a membrane is formed by the same method except that the film thickness is set to be 60 μm, and an evaluation is performed by the same method. As a result, the Rmax (the maximum height of the surface roughness) is 1.6 μm or less before the test operation at 400° C. for 1000 hours, but the peeling of the membrane is observed after the test operation, further the Rmax becomes 6 μm, and the increase of the surface roughness is recognized.

Figure 3:
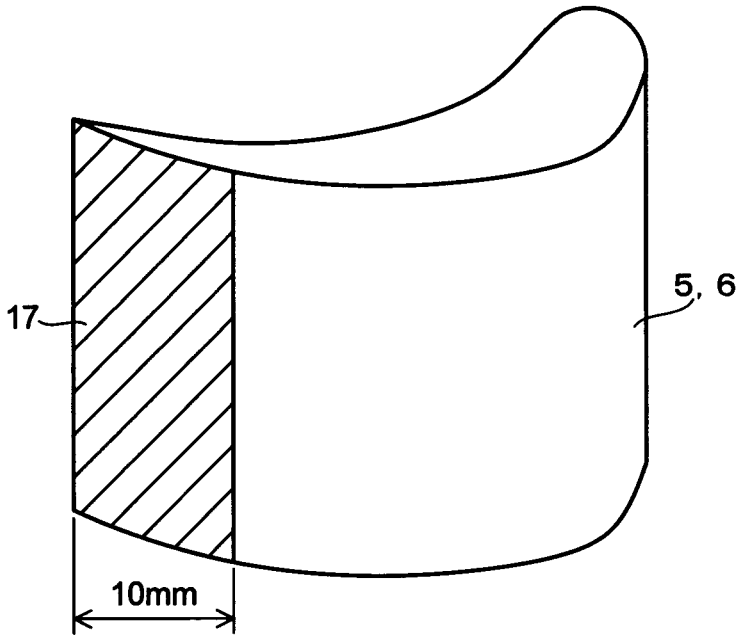
FIG. 3 is a view schematically illustrating a substantial configuration of a steam turbine blade according to an embodiment of the present invention.

As still another example, a forming portion (coating execution portion) (illustrated by adding oblique lines in FIG. 3) of a membrane 17 by the surface treatment is set to be a position of less than 10 mm from the rear edge of the stator blade 6 and the rotor blade 5 toward the upstream side and at the back side as illustrated in FIG. 3, for all of the rotor blades, stator blades at the high pressure stage and the intermediate pressure stage and an evaluation is performed by the same method. As a result, there is no difference when the turbine efficiency is compared to the one in which the coating execution portion is set to be the whole of the stator blade 6 and the rotor blade 5, and the membrane is formed entirely.

According to the steam turbine and the steam turbine blade of the above-stated embodiment, it is possible to maintain the initial high turbine efficiency level for a long time while suppressing the surface roughness change of the steam turbine blade caused by the oxidation, and the deterioration of the aerodynamic characteristics of the steam turbine blade in accordance with the surface roughness change.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The steam turbine and the steam turbine blade of the present invention can be used for a field of a steam turbine for power generation in a power generation plant and soon. Accordingly, the present invention has the industrial applicability.

What is claimed is:

1. A steam turbine, comprising:

a turbine rotor;

a rotor blade implanted to the turbine rotor;

a stator blade provided at an upstream side of the rotor blade; and a turbine casing supporting the stator blade and including the turbine rotor, the rotor blade and the stator blade, wherein a stage is formed by a pair of the rotor blade and the stator blade, and a steam passage is formed by arranging plural stages in an axial direction of the turbine rotor;

wherein a surface treatment including coating a ceramics precursor and decomposing the ceramics precursor by a heat treatment after coating the ceramics precursor is performed to form a ceramic layer directly on at least a part of a surface of the stator blade and a surface of the rotor blade exposed at approximately 350° C. to 610° C. so as to suppress an increase of a surface roughness caused by oxidation; and wherein the surface roughness is one in which a maximum height Rmax after the surface treatment is 1.6 μm or less.

2. The steam turbine according to claim 1, wherein the surface treatment is performed for at least a part of the surfaces of the stator blades at a high pressure stage and an intermediate pressure stage.

3. The steam turbine according to claim 1, wherein the surface treatment is performed for at least a part of the surfaces of the rotor blades at a high pressure stage and an intermediate pressure stage.

4. The steam turbine according to claim 1, wherein the stator blade and the rotor blade are made up of ferritic steel or super heat-resistant steel.

5. The steam turbine according to claim 1, wherein the surface treatment does not increase the surface roughness of a base material of the stator blade and the rotor blade.

6. The steam turbine according to claim 1, wherein a membrane formed by the surface treatment is oxide ceramics.

7. The steam turbine according to claim 1, wherein an average thickness of a membrane formed by the surface treatment is 0.01 μm or more and 50 μm or less.

8. The steam turbine according to claim 1, wherein a membrane formed by the surface treatment exists at a position of less than 10 mm from a rear edge of the stator blade and the rotor blade toward an upstream side and at a back side.

9. A steam turbine blade, used for a steam turbine including: a turbine rotor; a rotor blade implanted to the turbine rotor; a stator blade provided at an upstream side of the rotor blade; and a turbine casing supporting the stator blade and including the turbine rotor, the rotor blade and the stator blade, in which a stage is formed by a pair of the rotor blade and the stator blade, and a steam passage is formed by arranging plural stages in an axial direction of the turbine rotor, as the stator blade or the rotor blade, wherein a surface treatment including coating a ceramics precursor and decomposing the ceramics precursor by a heat treatment after coating the ceramics precursor is performed to form a ceramic layer directly on at least a part of a surface of the stator blade and a surface of the rotor blade exposed at approximately 350° C. to 610° C. so as to suppress an increase of a surface roughness caused by oxidation; and wherein the surface roughness is one in which a maximum height Rmax after the surface treatment is 1.6 μm or less.

10. The steam turbine blade according to claim 9, wherein the steam turbine blade is made up of ferritic steel or super heat-resistant steel.

11. The steam turbine blade according to claim 9, wherein the surface treatment does not increase the surface roughness of a base material.

12. The steam turbine blade according to claim 9, wherein a membrane formed by the surface treatment is oxide ceramics.

13. The steam turbine blade according to claim 9, wherein an average thickness of a membrane formed by the surface treatment is 0.01 μm or more and 50 μm or less.

14. The steam turbine blade according to claim 9, wherein a membrane formed by the surface treatment exists at a position of less than 10 mm from a rear edge of the steam turbine blade toward an upstream side and at a back side.

15. A method of forming the steam turbine blade according to claim 9, comprising:

preparing a steam turbine blade for a steam turbine including a turbine rotor, a rotor blade implanted to the turbine rotor, a stator blade provided at an upstream side of the rotor blade, and a turbine casing supporting the stator blade and including the turbine rotor, the rotor blade and the stator blade, in which a stage is formed by a pair of the rotor blade and the stator blade, and a steam passage is formed by arranging plural stages in an axial direction of the turbine rotor, as the stator blade or the rotor blade;

coating a ceramics precursor directly on at least a part of a surface of the stator blade and a surface of the rotor blade; and decomposing the ceramics precursor by a heat treatment at approximately 350° C. to 610° C. to form a ceramic layer directly on at least the part of the surface of the stator blade and the surface of the rotor blade, the ceramic layer having a surface roughness in which a maximum height Rmax is 1.6 μm or less.

* * * * *